US012753957B2

(12) United States Patent
Kim et al.

(10) Patent No.: US 12,753,957 B2
(45) Date of Patent: Oct. 6, 2026

(54) HEAT PUMP SYSTEM AND CONTROL METHOD THEREOF

(71) Applicant: Samsung Electronics Co., Ltd., Suwon-si (KR)

(72) Inventors: Taeil Kim, Suwon-si (KR); Sukho Lee, Suwon-si (KR); Min Chang, Suwon-si (KR); Sangyoon Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 17 days.

(21) Appl. No.: 18/802,836

(22) Filed: Aug. 13, 2024

(65) Prior Publication Data

US 2024/0401855 A1 Dec. 5, 2024

Related U.S. Application Data

(63) Continuation of application No. PCT/KR2023/002123, filed on Feb. 14, 2023.

(30) Foreign Application Priority Data

Mar. 15, 2022 (KR) ..... 10-2022-0031863

(51) Int. Cl.
*F25B 41/31* (2021.01)
*F25B 13/00* (2006.01)

(52) U.S. Cl.
CPC ..... *F25B 41/31* (2021.01); *F25B 13/00* (2013.01)

(58) Field of Classification Search
CPC . F25B 2313/003; F24H 15/232; F24H 15/385
See application file for complete search history.

(56) References Cited

U.S. PATENT DOCUMENTS 9,746,210 B2 8/2017 Ko et al.
9,951,962 B2 * 4/2018 Tamaki ..... F24H 15/385
(Continued)

FOREIGN PATENT DOCUMENTS

EP 1972871 A2 * 9/2008 ..... F25B 49/027
EP 1972871 9/2016
(Continued)

OTHER PUBLICATIONS

International Search Report for PCT/KR2023/002123 mailed May 30, 2023, 6 pages.
(Continued)

*Primary Examiner* — Lionel Nouketcha
(74) *Attorney, Agent, or Firm* — Nixon & Vanderhye P.C.

(57) ABSTRACT

A heat pump system according to an aspect of the disclosure may comprise: a compressor configured to compress a refrigerant; a water heat exchanger configured to exchange heat between the compressed refrigerant and introduced water; an expansion valve configured to expand the refrigerant condensed in the water heat exchanger; an outdoor heat exchanger configured to exchange heat between the refrigerant expanded by the expansion valve and outdoor air; a high-tension pressure sensor configured to detect the temperature of the refrigerant to be condensed in the water heat exchanger; a discharged water temperature sensor configured to detect the temperature of water on which heat exchange has been performed in the water heat exchanger; and a control unit including a controller comprising circuitry configured to: determine a target condensation temperature of the refrigerant based on a detection result of the discharged water temperature sensor, compare the target condensation temperature with the current condensation temperature detected by the high-tension pressure sensor, and
(Continued)

control the degree of opening of the expansion valve based on the comparison result.

15 Claims, 12 Drawing Sheets

(56) References Cited

U.S. PATENT DOCUMENTS

| | | | | |
|---|---|---|---|---|
| 2009/0199581 | A1* | 8/2009 | Ushijima | F25B 30/02 62/238.7 |
| 2010/0236283 | A1* | 9/2010 | Ballet | F25B 43/003 96/113 |
| 2013/0213072 | A1* | 8/2013 | Kawagoe | F25B 30/02 62/238.6 |
| 2020/0191423 | A1 | 6/2020 | Sun et al. | |
| 2021/0063042 | A1 | 3/2021 | Bak et al. | |
| 2022/0057122 | A1* | 2/2022 | Kasai | F25B 13/00 |

FOREIGN PATENT DOCUMENTS

| | | | |
|---|---|---|---|
| EP | 3587957 | B1 | 8/2023 |
| JP | 3030110 | B2 | 2/2000 |
| JP | 2008157550 | A | 7/2008 |
| JP | 2008232508 | A | 10/2008 |
| KR | 19980035253 | A | 8/1998 |
| KR | 100355826 | B1 | 11/2002 |
| KR | 100866738 | B1 | 11/2008 |
| KR | 20090069921 | A | 7/2009 |
| KR | 100988617 | B1 | 10/2010 |
| KR | 101266098 | B1 | 5/2013 |
| KR | 101591191 | B1 | 2/2016 |
| KR | 101794449 | B1 | 12/2017 |
| KR | 101806154 | B1 | 1/2018 |
| KR | 101965182 | B1 | 4/2019 |
| KR | 20190054797 | A | 5/2019 |
| KR | 102043215 | B1 | 11/2019 |
| KR | 20200116683 | A | 10/2020 |
| KR | 20210026645 | A | 3/2021 |
| KR | 20230153060 | A | 11/2023 |

OTHER PUBLICATIONS

Written Opinion of the ISA for PCT/KR2023/002123 mailed May 30, 2023, 5 pages.

Extended European Search Report dated May 21, 2025 issued in European Patent Application No. 23770972.0.

Korean Office Action dated May 26, 2026 for KR Application No. 10-2022-0031863.

* cited by examiner

FIG. 1
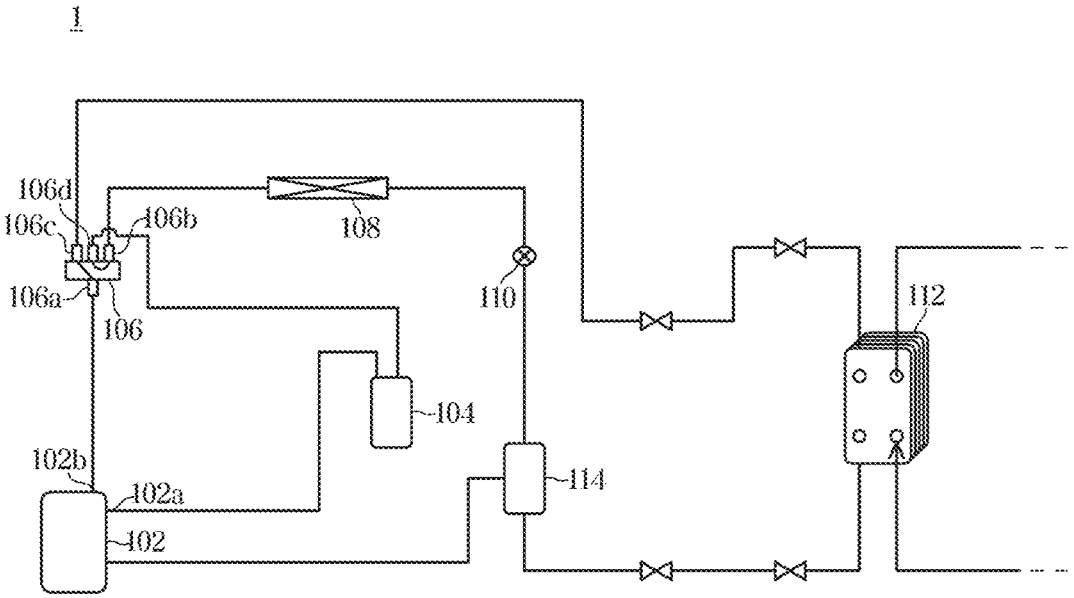
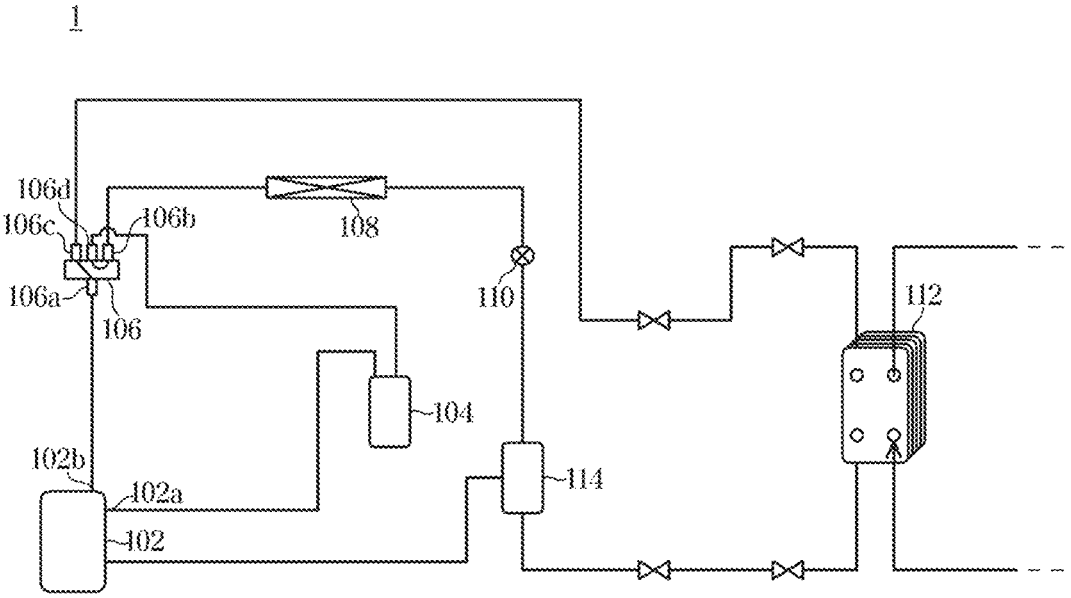

FIG. 7

| LOWER LIMIT | TARGET CONDENSATION TEMPERATURE | UPPER LIMIT |
|---|---|---|
| HIGHER ONE OF INPUT WATER TEMPERATURE + VALUE OF A4 AND LOW ABSOLUTE PRESSURE * (MINIMUM COMPRESSION RATIO + A5) | WATER OUTPUT TEMPERATURE + A1 | LOWER ONE OF MAXIMUM WATER OUTPUT TEMPERATURE + VALUE OF A2 AND TARGET WATER OUTPUT TEMPERATURE + VALUE OF A3 |

FIG. 8

| TARGET CONDENSATION TEMPERATURE > CURRENT CONDENSATION TEMPERATURE | TARGET CONDENSATION TEMPERATURE = CURRENT CONDENSATION TEMPERATURE | TARGET CONDENSATION TEMPERATURE < CURRENT CONDENSATION TEMPERATURE |
|---|---|---|
| REDUCTION CONTROL OVER OPENING DEGREE OF EXPANSION VALVE | MAINTAIN OPENING DEGREE OF EXPANSION VALVE | INCREASE CONTROL OVER OPENING DEGREE OF EXPANSION VALVE |

HEAT PUMP SYSTEM AND CONTROL METHOD THEREOF

CROSS-REFERENCE TO RELATED APPLICATIONS

This application is a continuation of International Application No. PCT/KR2023/002123 designating the United States, filed on Feb. 14, 2023, in the Korean Intellectual Property Receiving Office and claiming priority to Korean Patent Application No. 10-2022-0031863, filed on Mar. 15, 2022, in the Korean Intellectual Property Office, the disclosures of each of which are incorporated by reference herein in their entireties.

BACKGROUND

Field

The disclosure relates to a heat pump system and method of controlling the same, and for example, to a heat pump type system and method of controlling the same, capable of supplying hot water through heat exchange.

Description of Related Art

In general, heat naturally moves from a side of high temperature to a side of low temperature, and some external action needs to be applied to move the heat from the low temperature side to the high temperature side. This is a principle of a heat pump. The heat pump performs cooling, heating (air to air) and water supply (air to water) using the heat produced and recovered in a circulation process of compression, condensation and evaporation of a refrigerant.

A multi-type cooling and heating device (hereinafter, referred to as an air conditioning system) that uses the heat pump method is comprised of an outdoor unit, an indoor unit, a hydro unit and a water tank unit, and uses the heat of the heat pump for indoor floor heating, hot water supply, indoor air cooling or heating, etc.

A heat pump system of the traditional air conditioner exchanges heat with air through an evaporator of the outdoor unit and controls the temperature of indoor air to meet the demand of the user through a condenser of the indoor unit.

An eco heating/cooling solution (EHS) system also exchanges heat with air through the outdoor unit, but supplies water of a temperature that meets a user demand by performing heat exchange between a refrigerant and water through a heat exchanger in the indoor unit or the outdoor unit.

The EHS system is classified into a mono system with both an evaporator and a condenser arranged in the outdoor unit and a split system with an evaporator arranged in the outdoor unit and a condenser arranged inside, and the supplied water is used for floor heating, radiator, hot water supply, a fan coil unit, etc.

An expansion valve, which changes high-pressure refrigerant to low-pressure refrigerant through phase change of the refrigerant, is controlled with an electric expansion valve (EEV), and when there is no pressure sensor in the system, expansion valve control is performed based on the compressor discharge temperature through a temperature sensor, or when there are both the pressure sensor and the temperature sensor, low pressure is measured, temperature at an inlet of a low-pressure compressor is measured, and then low-pressure superheat degree is also controlled.

In order to increase the heating operation efficiency of the air conditioner and extend the operation limit, an injection compressor is applied through a supercooling heat exchanger in addition to the main components, the evaporator, condenser, compressor and expansion valve, in which case, EEV control is performed to secure a low-pressure superheat degree through a pressure sensor and a temperature sensor.

When EEV control is performed to secure a low-pressure superheat degree in a system that employs the injection compressor, required injection conditions vary depending on operation conditions (outdoor temperature and water temperature) and an optimal amount of refrigerant of the condenser, evaporator, and supercooling heat exchanger varies, so simple suction superheat degree control only leads to a rise in high pressure beyond an optimal condition, thereby reducing efficiency or exceeding reliable high pressure level, and on the contrary, when the injection flow rate is insufficient, the compressor discharge temperature may overly increase, causing a problem with compressor reliability.

SUMMARY

Embodiments of the disclosure provide a heat pump system and method of controlling the same, by which expansion valve control is performed based on a target condensation temperature to attain hot water output, increase operation reliability under low/high temperature outdoor conditions and perform a heating operation at an improved efficiency.

According to an example embodiment of the disclosure, a heat pump system includes: a compressor configured to compress a refrigerant; a high-pressure pressure sensor configured to detect pressure of the compressed refrigerant; a water heat exchanger configured to exchange the compressed refrigerant heat with input water; an expansion valve configured to expand the refrigerant condensed in the water heat exchanger; an outdoor heat exchanger configured to exchange heat with outdoor air based on the refrigerant expanded in the expansion valve; a supercooling temperature sensor configured to detect a temperature of the refrigerant having passed the water heat exchanger; a water output temperature sensor configured to detect a temperature of water having undergone heat exchange in the water heat exchanger; and a controller comprising circuitry configured to: determine a target condensation temperature of the refrigerant based on a detection result of the water output temperature sensor, compare the target condensation temperature with a current condensation temperature obtained by converting the pressure detected by the high-pressure pressure sensor into a saturation temperature, and control an opening degree of the expansion valve based on a result of the comparing.

An outdoor temperature sensor configured to detect outdoor temperature may be further included, and the controller may be configured to set an upper limit of the target condensation temperature based on a maximum water output temperature depending on the outdoor temperature detected by the outdoor temperature sensor and a target water output temperature.

An input water temperature sensor configured to detect input water temperature may be further included, and the controller may be configured to set a lower limit of the target condensation temperature based on the input water temperature detected by the input water temperature sensor and a minimum compression ratio.

The controller may be configured to: control the expansion valve to increase an opening degree of the expansion valve in response to a current condensation temperature based on a detection result of the condensation temperature, which is a value obtained by converting the pressure detected by the high-pressure pressure sensor into a saturation temperature, being higher than the determined target condensation temperature.

The controller may be configured to: control the expansion valve to decrease an opening degree of the expansion valve in response to a current condensation temperature based on a detection result of the condensation temperature, which is a value obtained by converting the pressure detected by the high-pressure pressure sensor into a saturation temperature, being lower than the determined target condensation temperature.

The controller may be configured to: set a value obtained by adding a first constant to a current water output temperature detected by the water output temperature sensor to the target condensation temperature.

The controller may be configured to: set a lower one of a value obtained by adding a second constant to a maximum water output temperature based on the outdoor temperature detected by the outdoor temperature sensor and a value obtained by adding a third constant to the target water output temperature to an upper limit of the target condensation temperature.

The controller may be configured to: set a higher one of a value obtained by adding a fourth constant to the input water temperature detected by the input water temperature sensor and a value obtained by multiplying a value obtained by adding a fifth constant to the minimum compression ratio by a low absolute pressure to a lower limit of the target condensation temperature.

An accumulator configured to temporarily store the refrigerant and separate a refrigerant in a liquid state not yet evaporated may be further included, and the controller may be configured to control the expansion valve to not reduce an opening degree of the expansion valve in response to determining that there is no refrigerant in the accumulator.

A low-pressure temperature sensor and a low-pressure pressure sensor configured to detect low-pressure temperature and low-pressure pressure of the refrigerant before flowing into the accumulator may be further included, and the controller may be configured to: control an opening degree of the expansion valve based on a difference between the low-pressure temperature detected by the low-pressure temperature sensor and a low-pressure saturation temperature based on pressure detected by the low-pressure pressure sensor.

The controller may be configured to: control the expansion valve not to reduce an opening degree of the expansion valve and also control a low-pressure superheat degree in response to the low-pressure temperature determined to be higher than the low-pressure saturation temperature.

The compressor may include a first compressor configured to compress the refrigerant having passed the water heat exchanger flowing thereto, and a second compressor configured to compress both the refrigerant having passed the first compressor and a refrigerant branched and injected from a supercooling heat exchanger located between the water heat exchanger and the expansion valve flowing thereto.

First to fifth constants may be determined based on a deviation between an actual temperature and a detected temperature and an optimal condensation temperature.

According to an example embodiment of the disclosure, a method of controlling a heat pump system includes: detecting pressure of a refrigerant compressed by a compressor and setting a value obtained by converting the pressure into a saturation temperature to a condensation temperature; detecting temperature of water having undergone heat exchange in the water heat exchanger; determining a target condensation temperature of the refrigerant based on the detected temperature of the water having undergone heat exchange; comparing the target condensation temperature with the detected current condensation temperature of a high-pressure pressure sensor; and controlling an opening degree of an expansion valve based on a result of the comparing.

Detecting outdoor temperature may be further included, and the determining of the target condensation temperature may include: setting an upper limit of the target condensation temperature based on a maximum water output temperature based on the detected outdoor temperature and a target water output temperature.

Detecting input water temperature may be further included, and the determining of the target condensation temperature may include: setting a lower limit of the target condensation temperature based on the detected input water temperature and a minimum compression ratio.

The controlling of the opening degree of the expansion valve may include: controlling the expansion valve to increase the opening degree of the expansion valve in response to the detected current condensation temperature of a high-pressure pressure sensor being higher than the determined target condensation temperature.

The controlling of the opening degree of the expansion valve may include: controlling the expansion valve to decrease the opening degree of the expansion valve in response to the detected current condensation temperature of a high-pressure pressure sensor being lower than the determined target condensation temperature.

The determining of the target condensation temperature may include: setting a value obtained by adding a first constant to the detected current water output temperature to the target condensation temperature.

The setting of the upper limit of the target condensation temperature may include: setting a lower one of a value obtained by adding a second constant to a maximum water output temperature based on the detected outdoor temperature and a value obtained by adding a third constant to the target water output temperature to an upper limit of the target condensation temperature.

The setting of the lower limit of the target condensation temperature may include: setting a higher one of a value obtained by adding a fourth constant to the detected input water temperature and a value obtained by multiplying a value obtained by adding a fifth constant to the minimum compression ratio by a low absolute pressure to a lower limit of the target condensation temperature.

Controlling the expansion valve not to decrease an opening degree of the expansion valve in response to determining that there is no refrigerant in the accumulator may be further included.

Detecting low-pressure temperature and low-pressure pressure of the refrigerant before flowing into the accumulator may be further included, and the controlling of the expansion valve may include controlling the opening degree of the expansion valve based on a difference between the detected low-pressure temperature and a low-pressure saturation temperature based on the detected pressure.

The controlling of the opening of the expansion valve may include: controlling the expansion valve not to reduce the opening degree of the expansion valve and controlling a low-pressure superheat degree in response to the low-pressure temperature determined to be higher than the low-pressure saturation temperature.

Compressing the refrigerant may be further included, and the compressing of the refrigerant may include: a first compression process in which the refrigerant having passed the water heat exchanger flows in and is compressed, and a second compression process in which both the refrigerant having passed the first compression process and a refrigerant branched and injected from a supercooling heat exchanger located between the water heat exchanger and the expansion valve flow in and are compressed.

First to fifth constants may be determined based on a deviation between an actual temperature and a detected temperature and an optimal condensation temperature.

According to various example embodiments of the disclosure, expansion valve control is performed based on a target condensation temperature to attain hot water output, increase operation reliability under low/high temperature outdoor conditions, and perform a heating operation at an improved efficiency.

BRIEF DESCRIPTION OF THE DRAWINGS

The above and other aspects, features and advantages of certain embodiments of the present disclosure will be more apparent from the following detailed description, taken in conjunction with the accompanying drawings, in which:

FIG. 1 is a diagram illustrating an example configuration of a heat pump system, according to various embodiments;

FIG. 7 is a table illustrating a target condensation temperature, according to various embodiments;

FIG. 8 is a table illustrating an example of how to control the opening degree of an expansion valve depending on condensation temperature, according to various embodiments;

DETAILED DESCRIPTION

Figure 2:
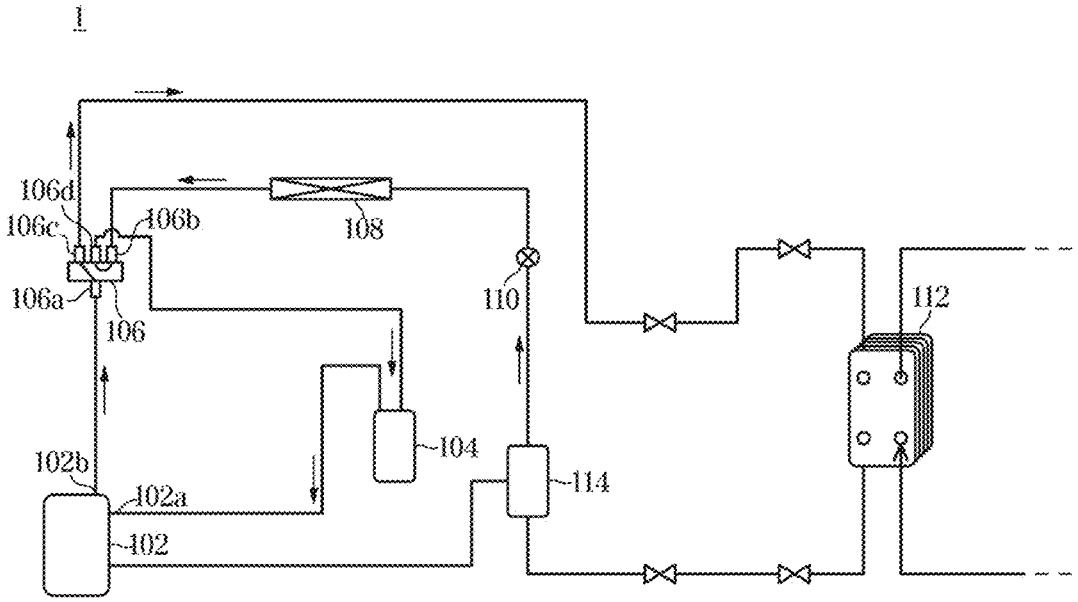
FIG. 2 is a diagram illustrating example flows of a refrigerant in a heat pump system, according to various embodiments.

Embodiments and features as described and illustrated in the disclosure are merely examples, and there may be various modifications replacing the various embodiments and drawings at the time of filing this application.

Throughout the drawings, like reference numerals refer to like parts or components.

The terminology used herein is for the purpose of describing various embodiments only and is not intended to limit the disclosure. It is to be understood that the singular forms "a," "an," and "the" include plural references unless the context clearly dictates otherwise. It will be further understood that the terms "comprise" and/or "comprising," when used in this disclosure, specify the presence of stated features, integers, steps, operations, elements, and/or components, but do not preclude the presence or addition of one or more other features, integers, steps, operations, elements, components, and/or groups thereof.

Furthermore, throughout the disclosure, when a component is "connected" or "coupled" to another component, it includes not only a case that the component is directly connected or coupled to the other component but also a case that they are indirectly connected or coupled to each other.

The terms including ordinal numbers like "first" and "second" may be used to explain various components, but the components are not limited by the terms. The terms are only for the purpose of distinguishing a component from another. Thus, a first component discussed below could be termed a second component and vice versa, without departing from the teachings of the disclosure. Descriptions shall be understood as to include any and all combinations of one or more of the associated listed items when the items are described using the conjunctive term "~ and/or ~," or the like.

Reference will now be made to various example embodiments of the disclosure, which are illustrated in the accompanying drawings.

FIG. 1 is a diagram illustrating an example configuration of a heat pump system, according to various embodiments.

A heat pump system 1 may include a compressor 102, a water heat exchanger 112, an expansion valve 110, an outdoor heat exchanger 108, a flow path switching valve 106 and an accumulator 104.

The compressor 102 compresses a low-temperature and low-pressure refrigerant drawn in through an inlet 102*a* to form a high-temperature and high-pressure refrigerant, and discharges the high-temperature and high-pressure refrigerant through an outlet 102*b*. The compressor 102 may be configured as an inverter compressor with the compression capacity varying by input frequency, or may be configured as a combination of a plurality of constant-speed compressors having constant compression capacity. The inlet 102*a* of the compressor 102 is connected to the accumulator 104, and the outlet 102*b* of the compressor 102 is connected to the flow path switching valve 106. The flow path switching valve 106 is also connected to the accumulator 104.

The accumulator 104 may be installed between the inlet 102*a* of the compressor 102 and the flow path switching valve 106. The accumulator 104 may temporarily store a mixture of oil and refrigerant when a condensed liquid refrigerant flows in through the flow path switching valve 106, and prevent/block the liquid refrigerant from being drawn into the compressor 102 by separating the liquid refrigerant not yet evaporated, thereby preventing or inhibiting the compressor 102 from being damaged. A gas refrigerant separated in the accumulator 104 is drawn into the inlet 102*a* of the compressor 102.

The flow path switching valve 106 may be configured with a four-way valve, which may form a refrigerant flow path required for operation in the corresponding mode by switching flows of the refrigerant discharged from the compressor 102 depending on the operation mode (cooling or heating). The flow path switching valve 106 may include a first port 106*a* connected to the outlet 102*b* of the compressor 100, a second port 106*b* connected to the outdoor heat exchanger 108, a third port 106*c* connected to the water heat exchanger 112, and a fourth port 106*d* connected to the accumulator 104 on a side of the inlet 102*a* of the compressor 100.

The outdoor heat exchanger 108 operates as a condenser in the cooling mode and operates as an evaporator in the heating mode. An end of the outdoor heat exchanger 108 is connected to the first expansion valve 110. An outdoor fan 109 may be installed in the outdoor heat exchanger 108 to increase heat exchange efficiency between the refrigerant and outdoor air.

The expansion valve 110 may be configured as an electronic expansion valve, which may expand the refrigerant, control the flow rate of the refrigerant, and when needed, block the flow of the refrigerant. The expansion valve 110 may be replaced by an expansion device having a different structure but performing the same function.

Multiple heat exchange plates through which the refrigerant passes and multiple heat exchange plates through which water passes are alternately installed in the water heat exchanger 112, and through heat exchange between the refrigerant passing heat exchange plates and the water passing heat exchange plates, cold water/hot water is produced. The water heat exchanger 112 may receive the refrigerant compressed in the compressor 102. The cold water/hot water produced in the water heat exchanger 112 is supplied to a water supply tank, a fan coil unit, a floor cooling/heating device, etc., and used for cold water/hot water supply and cooling/heating.

FIG. 2 is a diagram illustrating example flows of a refrigerant in an example heat pump system, according to various embodiments.

A example embodiment of the disclosure supplies hot water by heat exchange between refrigerant and water, so a refrigerant cycle for operation in the heating mode will be focused in the following description.

The controller 140 (refer, e.g., to FIG. 3) may operate the flow path switching valve 106 so that a refrigerant flow path having the first port 106*a* connected to the third port 106*c* and the second port 106*b* connected to the fourth port 106 may be formed.

Accordingly, the refrigerant discharged from the compressor 102 may flow into the water heat exchanger 112 through the flow path switching valve 106.

The refrigerant flowing into the water heat exchanger 112 flows into the outdoor heat exchanger 108 via the water heat exchanger 112. The refrigerant having passed the outdoor heat exchanger 108 may go through the flow path switching valve 106 again and may be drawn into the compressor 102.

The heat pump system 1 may form a refrigerant cycle that goes through a sequence of the compressor 102→the flow path switching valve 106→the water heat exchanger 112→the expansion valve 110→the outdoor heat exchanger 108→the flow path switching valve 106→the accumulator 104→the compressor 102 to perform heating operation.

The heat pump system 1 of the disclosure may further include a supercooling heat exchanger 114.

The supercooling heat exchanger 114 may be located between the water heat exchanger 112 and the expansion valve 110 to make the refrigerant flow into the compressor 102.

In this case, the compressor 102 may perform two-stage refrigerant compression.

The compressor 102 may include a first compressor having the refrigerant that has passed the water heat exchanger 112 flow thereto and compressed therein, and a second compressor having both the refrigerant that has passed the first compressor and the refrigerant branched and injected from the supercooling heat exchanger 114 located between the water heat exchanger 112 and the expansion valve 110 flow thereto and compressed therein.

Refrigerant injection into the compressor 102 by the supercooling heat exchanger 114 may be performed by singling out the refrigerant that has passed the water heat exchanger 112 and injecting a steamed or two-phase refrigerant into an injection port of the compressor 102.

Accordingly, the compressor 102 may compress not only the refrigerant that has passed the water heat exchanger 112 as in the existing cycle but also an extra refrigerant branched and injected from the supercooling heat exchanger 114.

With this, the efficiency of the compressor 102 may increase by supplying the steamed refrigerant into the injection port of the compressor 102, and the capacity of the condenser may increase by increasing the flow rate of the refrigerant on the side of the condenser. Furthermore, efficient operation may be performed by further securing the degree of subcooling of the refrigerant on the discharge side in the water heat exchanger 112 (or internal heat exchanger). In addition, the discharge temperature of the compressor 102 may be reduced, thereby increasing the operation range.

A basic configuration of the heat pump system 1 and flows of the refrigerant have thus far been described. Hereafter, an example procedure for setting a target condensation temperature and based on this, controlling the expansion valve 110 will be described in greater detail with reference to the drawings.

Figure 3:
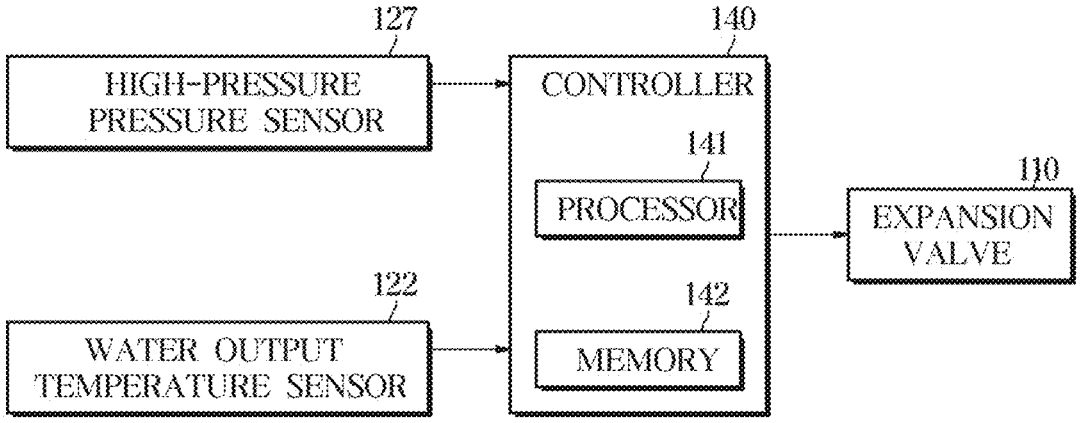
FIG. 3 is a block diagram illustrating an example configuration of a heat pump system, according to various embodiments.

FIG. 3 is a control block diagram of a heat pump system, according to an embodiment.

In addition to the expansion valve 110, the heat pump system 1 may further include a supercooling temperature sensor 120, a high-pressure pressure sensor 127, a water output temperature sensor 122 and the controller 140, and the controller 140 may include a processor (e.g., including processing circuitry) 141 and a memory 142.

The high-pressure pressure sensor 127 may detect the pressure of the refrigerant discharged by the compressor 102, and figure out a condensation temperature by calculation of saturation temperature from the pressure.

The supercooling temperature sensor 120 may detect a temperature of the refrigerant supercooled while exchanging heat with water in the process of passing through the water heat exchanger 112.

The water output temperature sensor 122 may detect a temperature of the water with which heat is exchanged in the process of passing through the water heat exchanger 112.

The expansion valve 110 may expand the refrigerant condensed after having passed the water heat exchanger 112, as described above.

The controller 140 may include the memory 142 for storing a control program and control data to control the expansion valve 110 and the processor 141 including various processing circuitry for generating control signals according to the control program and control data stored in the memory 142. The memory 142 and the processor 141 may be implemented integrally or separately.

The memory 142 may store temperature and pressure detected by various sensors, and first to fifth constants, as will be described later, in addition to the program and data for controlling the expansion valve 110.

The memory 142 may include a volatile memory 142 for temporarily storing data, such as a static random access memory (SRAM), a dynamic random access memory (DRAM), or the like. The memory 142 may also include a non-volatile memory 142 for storing data for a long time, such as a read-only memory (ROM), an erasable programmable ROM (EPROM), an electrically erasable programmable ROM (EEPROM), etc.

The processor 141 may include many different logic circuits and operation circuits, process data according to the program provided in the memory 142, and generate control signals according to the processing results. The processor 141 may include various processing circuitry and/or multiple processors. For example, as used herein, including the claims, the term "processor" may include various processing circuitry, including at least one processor, wherein one or more of at least one processor, individually and/or collectively in a distributed manner, may be configured to perform various functions described herein. As used herein, when "a processor", "at least one processor", and "one or more processors" are described as being configured to perform numerous functions, these terms cover situations, for example and without limitation, in which one processor performs some of recited functions and another processor(s) performs other of recited functions, and also situations in which a single processor may perform all recited functions. Additionally, the at least one processor may include a combination of processors performing various of the recited/disclosed functions, e.g., in a distributed manner. At least one processor may execute program instructions to achieve or perform various functions.

The controller 140 may receive information about a water output temperature detected from the water output temperature sensor 122 that detects the temperature of the water having gone through heat exchange in the water heat exchanger 112.

The controller 140 may determine a target condensation temperature of the refrigerant based on the information about the water output temperature.

In this case, in determining the target condensation temperature, the controller 140 may set a value obtained by adding the first constant to the current water output temperature to the target condensation temperature. The first constant will be described later.

The controller 140 may compare the determined target condensation temperature with a current condensation temperature of the refrigerant detected by the high pressure sensor 127, and control the pressure of the refrigerant by controlling the opening degree of the expansion valve 110 based on a result of the comparing.

The controller 140 may use information detected by various sensors in setting the target condensation temperature, and in this regard, the plurality of sensors included in the heat pump system 1 will be described first before a procedure for controlling the expansion valve 110 is described.

Figure 4:
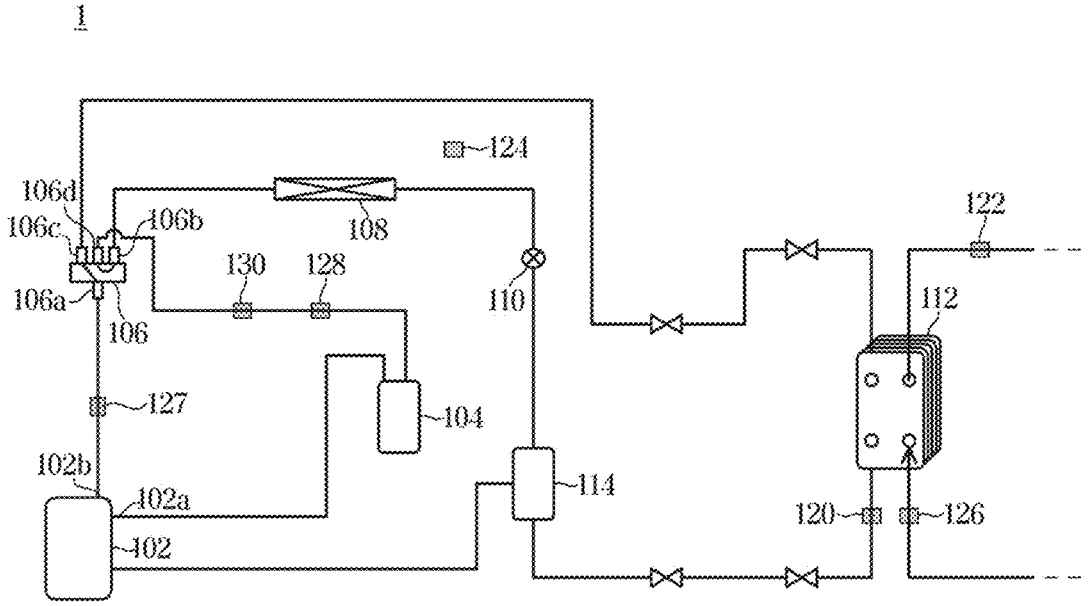
FIG. 4 is a diagram illustrating a plurality of sensors included in a heat pump system, according to various embodiments.

FIG. 4 is a diagram illustrating various example sensors of a plurality of sensors included in a heat pump system, according to various embodiments.

The heat pump system 1 may further include an outdoor temperature sensor 124, an input water temperature sensor 126, a low-pressure temperature sensor 128, a low-pressure pressure sensor 130, a supercooling temperature sensor 120 in addition to the aforementioned high-pressure pressure sensor 127 and the water output temperature sensor 122.

The outdoor temperature sensor 124 may detect the temperature of outdoor air, and the input water temperature sensor 126 may detect the temperature of water flowing into the water heat exchanger 112 before the water exchanges heat with the refrigerant in the water heat exchanger 112.

The low-pressure temperature sensor 128 and the low-pressure pressure sensor 130 may detect temperature and pressure of the refrigerant in a low-pressure state before the refrigerant having passed the outdoor heat exchanger 108 is compressed in the compressor 102.

Various information detected by the plurality of sensors may be used in the control procedure of the controller 140, which will be described in greater detail below.

Figure 5:
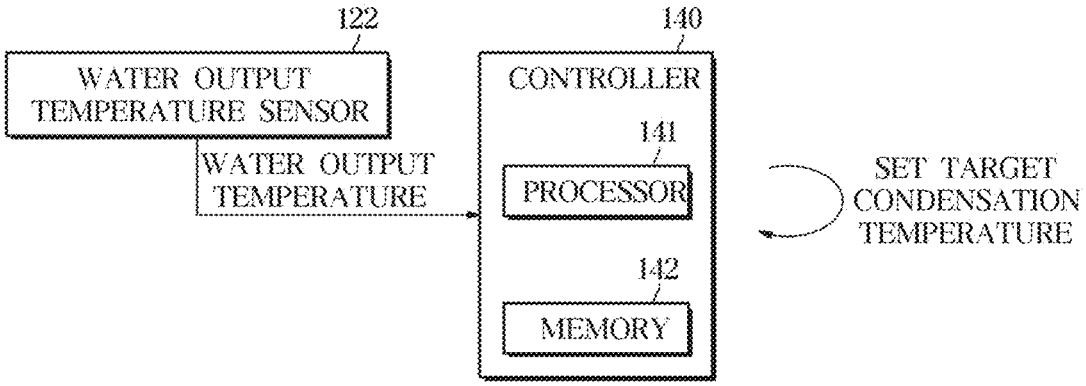
FIG. 5 is a diagram illustrating an example of a controller setting a target condensation temperature, according to various embodiments.
Figure 6A:
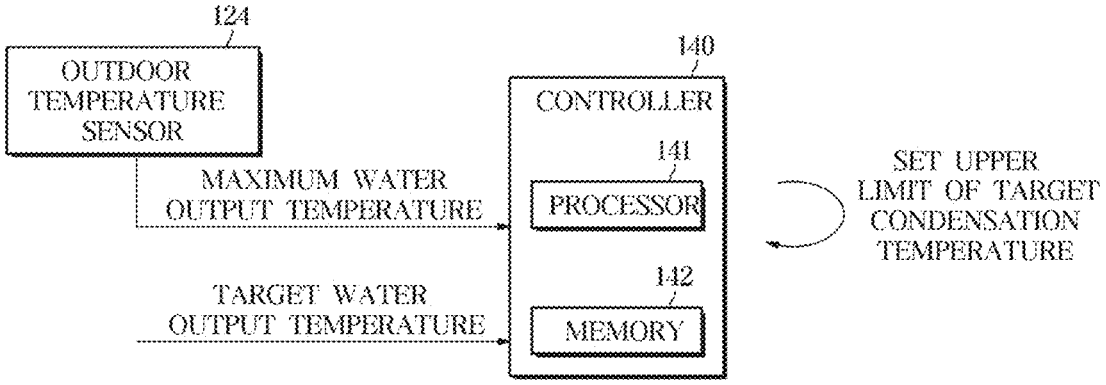
FIGS. 6A and 6B are block diagrams illustrating an example of a controller setting an upper limit and a lower limit of a target condensation temperature, according to various embodiments.
Figure 6B:
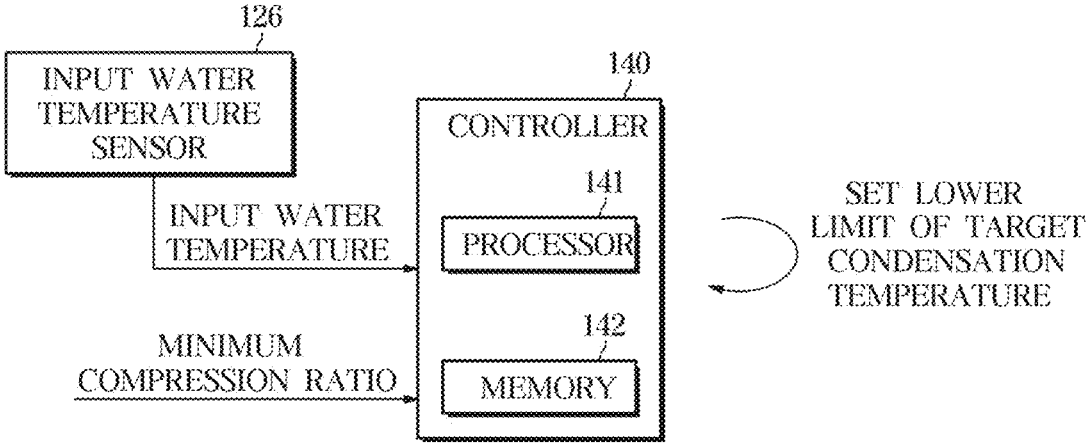

FIG. 5 is a diagram illustrating an example of a controller setting a target condensation temperature, according to various embodiments, and FIGS. 6A and 6B are diagrams illustrating an example of a controller setting an upper limit and a lower limit of a target condensation temperature, according to various embodiments. FIG. 7 is a table illustrating example target condensation temperature, according to various embodiments.

As described above, the controller 140 may receive information about a water output temperature detected from the water output temperature sensor 122, and based on this, determine a target condensation temperature. For example, the target condensation temperature may be set to be a value obtained by adding the first constant to a current water output temperature detected by the water output temperature sensor 122.

In this case, the target condensation temperature may be limited depending on the input/output water temperature, the minimum compression ratio and an operating section of the compressor 102, and taking these into account, the controller 140 may set an upper limit and a lower limit of the target condensation temperature.

The controller 140 may receive information about the outdoor temperature detected by the outdoor temperature sensor 124, and determine a maximum water output temperature, which is a highest temperature of the water having gone through heat exchange in the water heat exchanger 112 based on the outdoor temperature.

The controller 140 may set an upper limit of the target condensation temperature based on the determined maximum water output temperature and the target water output temperature.

For example, the controller 140 may set a lower one of a value obtained by adding the second constant to the maximum water output temperature based on the outdoor temperature detected by the outdoor temperature sensor 124 and a value obtained by adding the third constant to the target water output temperature to an upper limit of the target condensation temperature.

The controller 140 may receive information about an input water temperature detected by the input water temperature sensor 126. Based on the input water temperature and the minimum compression ratio of the compressor 102, a lower limit of the target condensation temperature may be set.

For example, the controller 140 may set a higher one of a value obtained by adding the fourth constant to the input water temperature detected by the input water temperature sensor 126 and a value obtained by multiplying a value obtained by adding the fifth constant to the minimum compression ratio by a low absolute pressure to a lower limit of the target condensation temperature.

The first, second, third, fourth and fifth (which may be referred to as first to fifth) constants are denoted as A1, A2, A3, A4 and A5 (which may be referred to as A1 to A5) in FIG. 7, which may be constant values determined based on a deviation between actual temperature and detected temperature and an optimal condensation temperature. Furthermore, the values may range, for example, between −5 and +5.

In this way, the controller 140 may determine the target condensation temperature of the refrigerant to be condensed through heat exchange in the water heat exchanger 112 based on the information detected by each of the plurality of sensors, and may set an upper limit and a lower limit of the target condensation temperature.

A procedure for controlling the opening degree of the expansion valve 110 depending on the determined condensation temperature and the current condensation temperature of the high-pressure pressure sensor 127 will now be described in greater detail.

FIG. 8 is a table illustrating an example of how to control the opening degree of an expansion valve depending on condensation temperature, according to various embodiments.

The expansion valve 110 may expand the refrigerant having passed the water heat exchanger 112, control the flow rate of the refrigerant, and when needed, block the flow of the refrigerant.

The controller 140 may control the pressure of the refrigerant by controlling the opening degree of the expansion valve 110 to control the expansion degree of the refrigerant.

In other words, when the opening degree of the expansion valve 110 decreases, the pressure of the refrigerant increases, and accordingly, the condensation temperature of the refrigerant increases as well. As the pressure of the refrigerant decreases with an increase of the opening degree of the expansion valve 110 and accordingly, condensation temperature of the refrigerant decreases, the target condensation temperature may be compared with the current condensation temperature and the opening degree of the expansion valve 110 may be increased or reduced depending on the result of the comparing.

For example, the controller 140 may compare the target condensation temperature with the current condensation temperature of the high-pressure pressure sensor 127, and control the expansion valve 110 to increase the opening degree of the expansion valve 110 when the current condensation temperature based on the detection result of the high-pressure pressure sensor 127 is higher than the target condensation temperature. That is, increasing the opening degree of the expansion valve 110 may further expand the refrigerant and thus, reduce the condensation temperature of the refrigerant.

Furthermore, the controller 140 may compare the target condensation temperature with the current condensation temperature, and control the expansion valve 110 to reduce the opening degree of the expansion valve 110 when the current condensation temperature based on the detection result of the condensation temperature of the high-pressure pressure sensor 127 is lower than the target condensation temperature. For example, decreasing the opening degree of the expansion valve 110 may less expand the refrigerant and thus, increase the condensation temperature of the refrigerant.

Furthermore, the controller 140 may compare the target condensation temperature with the current condensation temperature, and control the expansion valve 110 to maintain the current opening degree when the current condensation temperature based on the detection result of the condensation temperature of the high-pressure pressure sensor 127 is equal to the target condensation temperature.

By setting the target condensation temperature in this way and controlling the expansion valve 110 accordingly, it is possible to suppress a rise in high pressure beyond an operation range limit and thus enable the system to operate stably.

Figure 9:
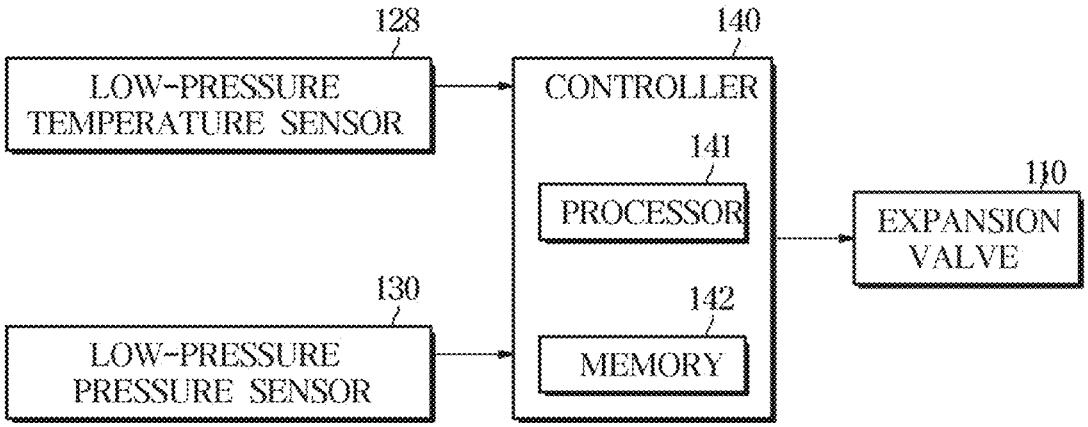
FIG. 9 is a block diagram illustrating an example configuration of a heat pump system, according to various embodiments.

FIG. 9 is a block diagram illustrating an example configuration of a heat pump system, according to various embodiments.

As described above, the heat pump system 1 may further include the accumulator 104 for temporarily storing the refrigerant and separating the refrigerant in the liquid state not yet evaporated.

The controller 140 may control the expansion valve 110 not to reduce the opening degree of the expansion valve 110 when it is determined that there is no refrigerant in the accumulator 104.

For example, when there is no refrigerant in the accumulator 104, the high pressure of the refrigerant that has passed the compressor 102 may increase, causing the refrigerant to be overheated, so the opening degree of the expansion valve 110 may be controlled not to be reduced so as to increase the flow rate of the refrigerant.

For this, the aforementioned low-pressure temperature sensor 128 and the low-pressure pressure sensor 130 may detect the temperature and the pressure of the refrigerant before the refrigerant passes the compressor 102, and the controller 140 may receive the detected information. The controller 140 may control the opening degree of the expansion valve 110 based on a difference between the low-pressure temperature detected by the low-pressure temperature sensor 128 and a low-pressure saturation temperature based on the pressure detected by the low-pressure pressure sensor 130.

For example, the controller 140 may determine that the refrigerant is overheated when the low-pressure temperature is determined to be higher than the low-pressure saturation temperature, and to correct this, control the expansion valve 110 to prevent and/or block the opening degree of the expansion valve 110 from being further reduced and also control a low-pressure superheat degree. This may prevent and/or inhibit the refrigerant from being superheated.

Figure 10:
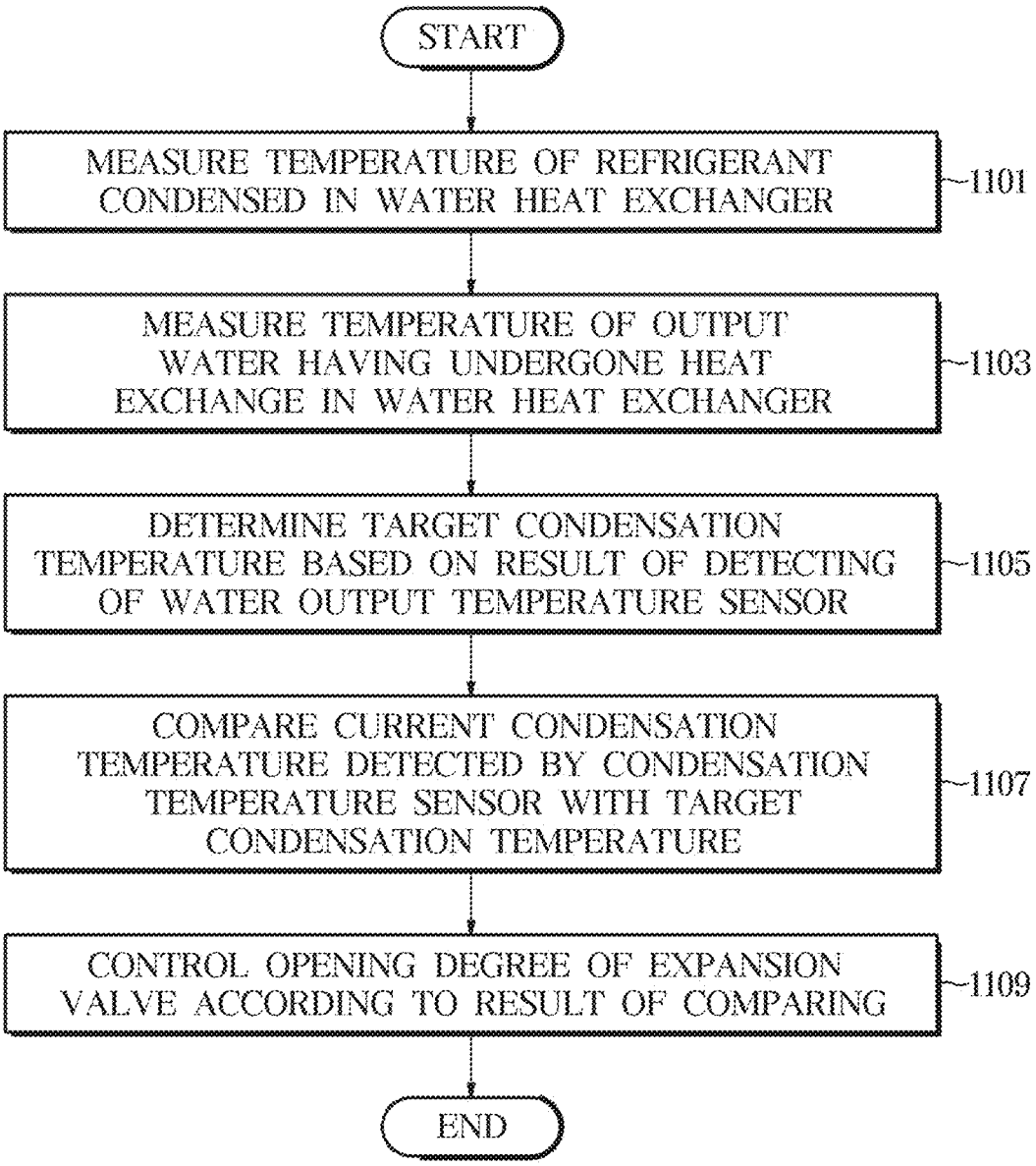
FIG. 10 is a flowchart illustrating an example method of controlling a heat pump system, according to various embodiments.

FIG. 10 is flowchart illustrating an example method of controlling a heat pump system, according to various embodiments.

The high-pressure pressure sensor 127 may detect or measure temperature of the refrigerant to be condensed in the water heat exchanger 112 in 1101, and the water output temperature sensor 122 may detect or measure the temperature of water that has gone through heat exchange in the water heat exchanger 112 in 1103.

The controller 140 may determine a target condensation temperature of the refrigerant based on the temperature of the water that has gone through heat exchange, which is detected by the water output temperature sensor 122, in 1105.

The controller 140 may compare the determined target condensation temperature with the temperature of the condensed refrigerant detected by the high-pressure sensor 127 in 1107, and control the opening degree of the expansion valve 110 based on a result of the comparing in 1109.

As described above, the target condensation temperature may be set to be a value obtained by adding the first constant to a current water output temperature detected by the water output temperature sensor 122.

Furthermore, the controller 140 may set an upper limit of the target condensation temperature based on the determined maximum water output temperature and the target water output temperature.

For example, the controller 140 may set a lower one of a value obtained by adding the second constant to the maximum water output temperature based on the outdoor temperature detected by the outdoor temperature sensor 124 and a value obtained by adding the third constant to the target water output temperature to an upper limit of the target condensation temperature.

The controller 140 may receive information about an input water temperature detected by the input water temperature sensor 126. Based on the input water temperature and a minimum compression ratio of the compressor 102, a lower limit of the target condensation temperature may be set.

For example, the controller 140 may set a higher one of a value obtained by adding the fourth constant to the input water temperature detected by the input water temperature sensor 126 and a value obtained by multiplying a value obtained by adding the fifth constant to the minimum compression ratio by a low absolute pressure to a lower limit of the target condensation temperature.

The aforementioned first to fifth constants are indicated as A1 to A5 in FIG. 7, which may be constant values determined based on a deviation between actual temperature and detected temperature and an optimal condensation temperature. Furthermore, the values may range, for example, between −5 and +5.

In this way, the controller 140 may determine the target condensation temperature of the refrigerant to be condensed through heat exchange in the water heat exchanger 112 based on the information detected by each of the plurality of sensors, and may set an upper limit and a lower limit of the target condensation temperature, and control the opening degree of the expansion valve 110 by comparing the target condensation temperature with the current condensation temperature.

Figure 11:
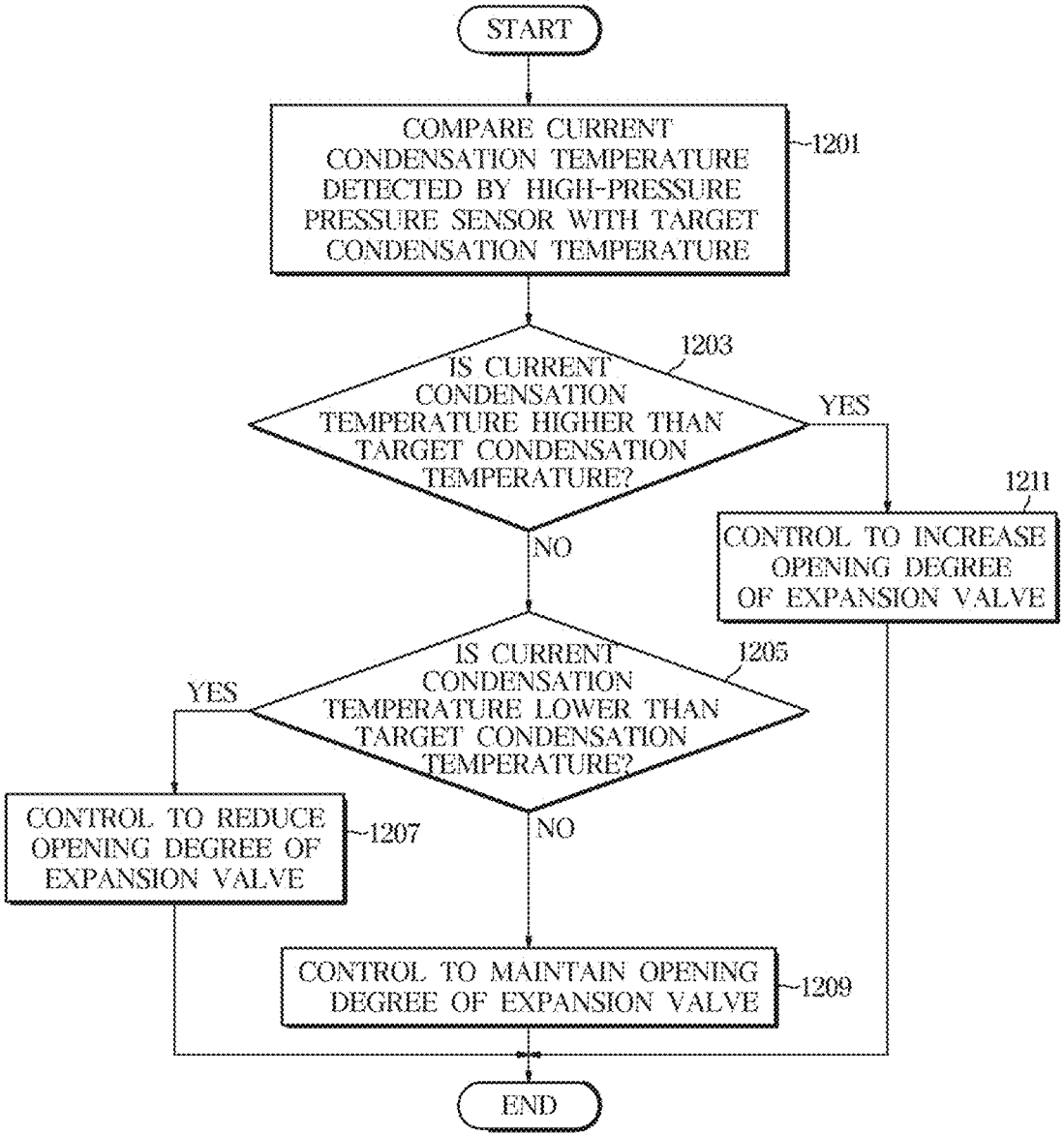
FIG. 11 is a flowchart illustrating an example method of controlling a heat pump system, according to various embodiments.

FIG. 11 is flowchart illustrating an example method of controlling a heat pump system, according to various embodiments.

The controller 140 may control the opening degree of the expansion valve 110 by comparing the target condensation temperature with the current condensation temperature.

When the opening degree of the expansion valve 110 decreases, the pressure of the refrigerant increases, and accordingly, the condensation temperature of the refrigerant increases as well. As the pressure of the refrigerant decreases with an increase of the opening degree of the expansion valve 110 and accordingly, condensation temperature of the refrigerant decreases, the target condensation temperature may be compared with the current condensation temperature and the opening degree of the expansion valve 110 may be increased or reduced depending on the result of the comparing.

For example, the controller 140 may compare the target condensation temperature with the current condensation temperature in 1201, and control the expansion valve 110 to increase the opening degree of the expansion valve 110 in 1211 when the current condensation temperature based on the detection result of the high-pressure pressure sensor 127 is higher than the target condensation temperature in 1203. For example, increasing the opening degree of the expansion valve 110 may further expand the refrigerant and thus, reduce the condensation temperature of the refrigerant.

Furthermore, the controller 140 may compare the target condensation temperature with the current condensation temperature in 1201, and control the expansion valve 110 in 1207 to reduce the opening degree of the expansion valve 110 when the current condensation temperature is not higher than the target condensation temperature in 1203 and the current condensation temperature based on the detection result of the high-pressure pressure sensor 127 is lower than the target condensation temperature in 1205. For example, decreasing the opening degree of the expansion valve 110 may less expand the refrigerant and thus, increase the condensation temperature of the refrigerant.

Furthermore, when the current condensation temperature is not lower than the target condensation temperature in 1205, e.g., the target condensation temperature is equal to the current condensation temperature, the controller 140 may control the expansion valve 110 in 1209 to maintain the current opening degree of the expansion valve 110.

By setting the target condensation temperature in this way and controlling the expansion valve 110 accordingly, it is possible to suppress a rise in high pressure beyond an operation range limit and thus enable the system to operate stably.

Figure 12:
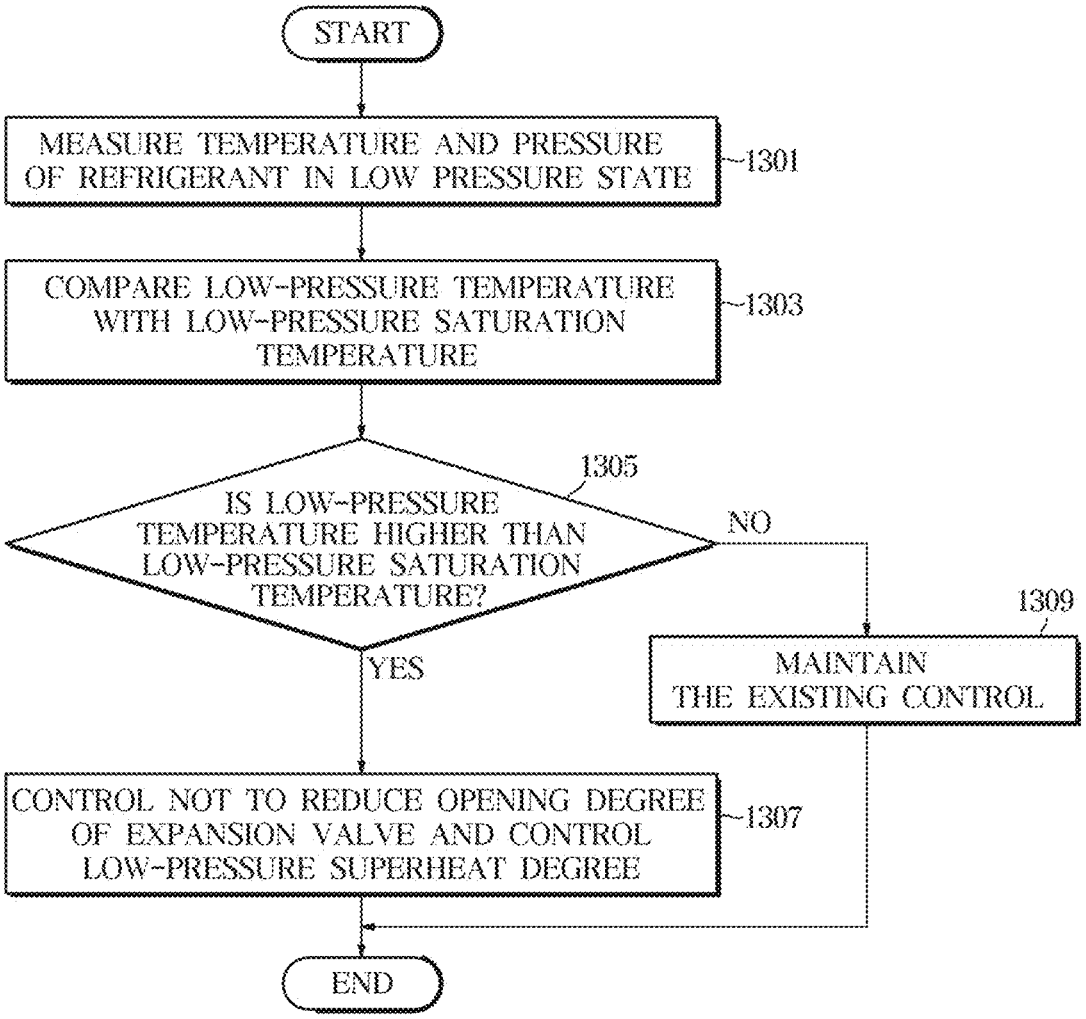
FIG. 12 is a flowchart illustrating an example method of controlling a heat pump system, according to various embodiments.

FIG. 12 is a flowchart illustrating an example method of controlling a heat pump system, according to various embodiments.

When there is no refrigerant in the accumulator 104, the high pressure of the refrigerant that has passed the compressor 102 may increase, causing the refrigerant to be overheated, so the controller 140 may control the expansion valve 110 not to reduce the opening degree of the expansion valve 110 so as to increase the flow rate of the refrigerant.

In this case, the low-pressure temperature sensor 128 and the low-pressure pressure sensor 130 may detect or measure temperature and pressure of the refrigerant in a low pressure state before passing through the compressor 102, in 1301.

The controller 140 may compare the low-pressure temperature detected by the low-pressure temperature sensor 128 and a low-pressure saturation temperature based on the pressure detected by the low-pressure pressure sensor 130, in 1303.

When the result of the comparing shows that the low-pressure temperature is higher than the low-pressure saturation temperature in 1305, it is determined that the refrigerant is overheated and to correct this, the expansion valve 110 may be controlled to not reduce the opening degree of the expansion valve 110 and a low-pressure superheat degree may also be controlled in 1307.

When the result of the comparing shows that the low-pressure temperature is not higher than the low-pressure saturation temperature in 1305, the controller 140 may maintain the existing control in 1309.

According to the disclosure of a heat pump system and method of controlling the same, expansion valve control is performed based on a target condensation temperature to attain hot water output, increase operation reliability under low/high temperature outdoor conditions, and perform a heating operation at an optimal efficiency.

The various example embodiments of the disclosure may be implemented in the form of a recording medium for storing instructions to be carried out by a computer. The instructions may be stored in the form of program codes, and when executed by a processor, may generate program modules to perform operations in the various embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

While the disclosure has been illustrated and described with reference to various example embodiments, it will be understood that the various example embodiments are intended to be illustrative, not limiting. It will be further understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

What is claimed is:

1. A heat pump system comprising:

a compressor configured to compress a refrigerant;

a water heat exchanger configured to exchange heat between the compressed refrigerant and input water to condense the refrigerant;

an expansion valve configured to expand the refrigerant after the refrigerant has been condensed in the water heat exchanger;

an outdoor heat exchanger configured to exchange heat between the refrigerant expanded in the expansion valve and outdoor air;

a high-pressure pressure sensor configured to detect a pressure of the refrigerant discharged by the compressor;

a water output temperature sensor configured to detect a temperature of water having undergone heat exchange in the water heat exchanger; and a controller including at least one processor, comprising processing circuitry, and the at least one processor being individually and/or collectively configured to:

determine a target condensation temperature of the refrigerant based on a result of detecting of the water output temperature sensor, determine a current condensation temperature by converting the pressure detected by the high-pressure pressure sensor into a saturation temperature, compare the target condensation temperature with the current condensation temperature, and control an opening degree of the expansion valve based on a result of comparing the target condensation temperature with the current condensation temperature.

2. The heat pump system of claim 1, wherein the compressor comprises: a first compressor including a refrigerant having passed the water heat exchanger flowing thereto and configured to be compressed therein, and a second compressor including both the refrigerant having passed the first compressor and a refrigerant branched and injected from a supercooling heat exchanger located between the water heat exchanger and the expansion valve flowing thereto and configured to be compressed therein.

3. The heat pump system of claim 1, further comprising: an outdoor temperature sensor configured to detect outdoor temperature, wherein the at least one processor is individually and/or collectively configured to set an upper limit of the target condensation temperature based on a maximum water output temperature based on the outdoor temperature detected by the outdoor temperature sensor and a target water output temperature.

4. The heat pump system of claim 3, further comprising: an input water temperature sensor configured to detect an input water temperature, wherein the at least one processor is individually and/or collectively configured to set a lower limit of the target condensation temperature based on the input water temperature detected by the input water temperature sensor and a minimum compression ratio.

5. The heat pump system of claim 4, wherein the at least one processor is individually and/or collectively configured to set a value obtained by adding a first constant to a current water output temperature detected by the water output temperature sensor to the target condensation temperature.

6. The heat pump system of claim 5, wherein the at least one processor is individually and/or collectively configured to set a lower one of a value obtained by adding a second constant to a maximum water output temperature based on an outdoor temperature detected by the outdoor temperature sensor and a value obtained by adding a third constant to the target water output temperature to an upper limit of the target condensation temperature.

7. The heat pump system of claim 6, wherein the at least one processor is individually and/or collectively configured to set a higher one of a value obtained by adding a fourth constant to the input water temperature detected by the input water temperature sensor and a value obtained by multiplying a value obtained by adding a fifth constant to the minimum compression ratio by a low absolute pressure to a lower limit of the target condensation temperature.

8. The heat pump system of claim 7, wherein the first, second, third, fourth and fifth constants are determined based on a deviation between an actual temperature and a detected temperature, and an optimal condensation temperature.

9. The heat pump system of claim 1, wherein the at least one processor is individually and/or collectively configured to, in response to the determined target condensation temperature being higher than the current condensation temperature, control the expansion valve to increase the opening degree of the expansion valve.

10. The heat pump system of claim 1, wherein the at least one processor is individually and/or collectively configured to, in response to the determined target condensation temperature being lower than the current condensation temperature, control the expansion valve to reduce the opening degree of the expansion valve.

11. The heat pump system of claim 1, further comprising: an accumulator configured to temporarily store the refrigerant and separate a refrigerant in a liquid state not yet evaporated, wherein the at least one processor is individually and/or collectively configured to, in response to determining that there is no refrigerant in the accumulator, control the expansion valve to not reduce the opening degree of the expansion valve.

12. The heat pump system of claim 11, further comprising: a low-pressure temperature sensor and a low-pressure pressure sensor configured to detect a low-pressure temperature and a low-pressure pressure of the refrigerant before flowing into the accumulator, wherein the at least one processor is individually and/or collectively configured to control an opening degree of the expansion valve based on a difference between the low-pressure temperature detected by the low-pressure temperature sensor and a low-pressure saturation temperature based on the pressure detected by the low-pressure pressure sensor.

13. The heat pump system of claim 12, wherein the at least one processor is individually and/or collectively configured to, in response to determining that the low-pressure temperature is higher than the low-pressure saturation temperature, control the expansion valve to not reduce the opening degree of the expansion valve and also control low-pressure superheat degree.

14. A method of controlling a heat pump system, the method comprising:

detecting temperature of a refrigerant condensed in a water heat exchanger;

detecting a temperature of water having undergone heat exchange in the water heat exchanger;

determining a target condensation temperature of the refrigerant based on the detected temperature of the water having undergone heat exchange;

comparing the target condensation temperature with the detected temperature of a currently condensed refrigerant; and controlling an opening degree of an expansion valve based on a result of the comparing.

15. The method of claim 14, further comprising: compressing the refrigerant, wherein the compressing of the refrigerant comprises a first compression procedure in which a refrigerant having passed the water heat exchanger flows in and is compressed, and a second compression procedure in which both the refrigerant having gone through the first compression procedure and a refrigerant branched and injected from a supercooling heat exchanger located between the water heat exchanger and the expansion valve flow in and are compressed.

* * * * *